United States Patent [19]

Fenkel

[11] 3,971,572

[45] July 27, 1976

[54] MAGAZINE COVER

[75] Inventor: Stanley O. Fenkel, Elkins Park, Pa.

[73] Assignee: David Anthony Desimone, N.J. ; a part interest

[22] Filed: May 20, 1975

[21] Appl. No.: 579,093

[52] U.S. Cl. ..... 281/46

[51] Int. Cl.[2] ..... B42D 3/00; B42D 17/00

[58] Field of Search ..... 281/46, 49, 50; 24/16 BP, 237

[56] References Cited

UNITED STATES PATENTS

| | | | |
|---|---|---|---|
| 828,297 | 8/1906 | Barrett et al. | 281/49 |
| 1,521,874 | 1/1925 | Dygert | 281/46 |
| 1,531,330 | 3/1925 | Battle | 281/49 |
| 2,181,968 | 12/1939 | Ericson et al. | 281/46 |
| 3,251,364 | 5/1966 | Goldman | 402/22 |
| 3,571,861 | 3/1971 | Olson | 24/30.5 |
| 3,734,634 | 5/1973 | Fenston | 402/80 R |

FOREIGN PATENTS OR APPLICATIONS

| | | |
|---|---|---|
| 255,369 | 7/1967 | Austria |

*Primary Examiner*—Jerome Schnall
*Attorney, Agent, or Firm*—Paul & Paul

[57] ABSTRACT

A magazine binder has a fixed slot at its one edge for receiving and retaining a corresponding edge of a magazine at the center fold portion thereof. A finger projects outwardly from the opposite edge of the binder. This finger is foldable inwardly into a locking channel after the magazine has been placed in the binder, thereby to form a second slot which functions to retain the magazine at its other edge at its center fold portion.

2 Claims, 7 Drawing Figures

MAGAZINE COVER

BACKGROUND OF THE INVENTION

This invention relates to a binder for magazines, periodicals, and the like. The binder may also be termed a cover, or a holder. For convenience, the term binder will be used throughout this patent application.

Binders have heretofore been provided for magazines and the like but such binders have been relatively expensive as compared with the binder of the present invention.

SUMMARY OF THE INVENTION

A principal object of the present invention is to provide a low cost binder of plastic material which may accommodate one or more periodicals.

Another object of the invention is to provide a rigid low cost plastic binder having simplified means for locking one or more magazines into the binder.

DETAILED DESCRIPTION OF THE PREFERRED EMBODIMENTS

Figure 1:
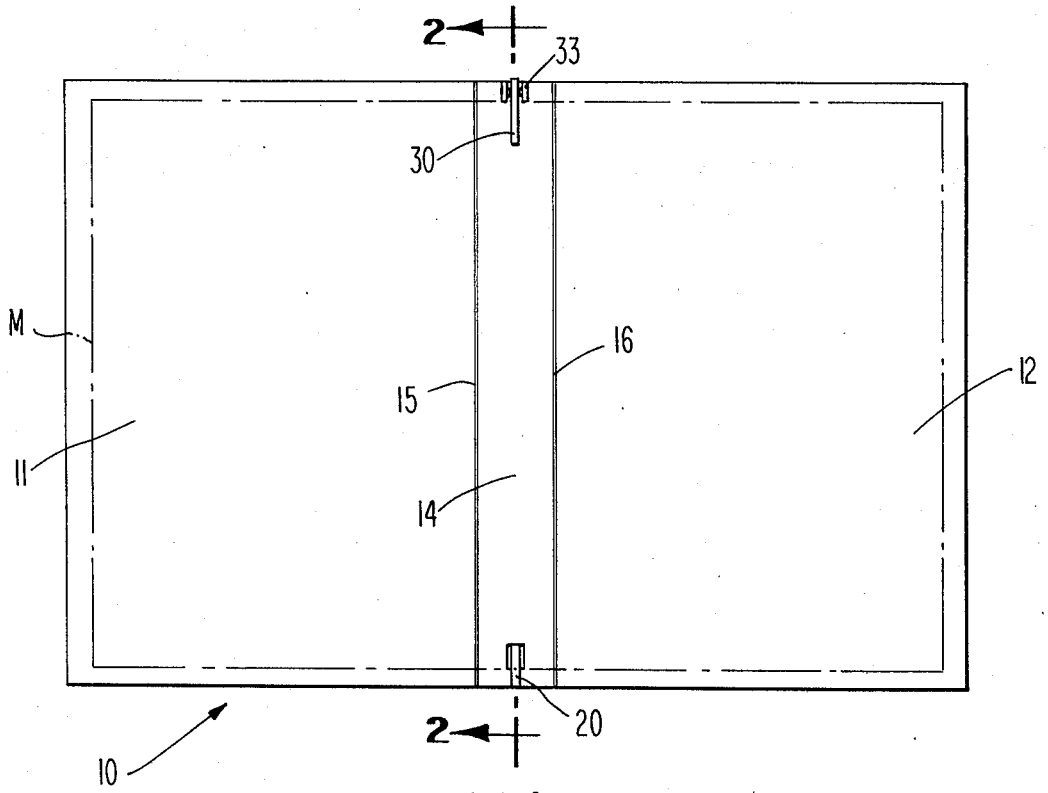
FIG. 1 is a plan view of a binder according to the present invention.

FIG. 1 shows a plan view of a binder 10 having a front cover portion 11, a rear cover portion 12, and a hinge or spine portion 14. Hinge portion 14 is flexible along the junction lines 15 and 16 which join the hinge portion 14 to the front and rear cover portions 11 and 12, respectively. The cover portions 11 and 12, and the hinge portion 14, are otherwise semi-rigid, preferably a semi-rigid plastic.

Figure 2:
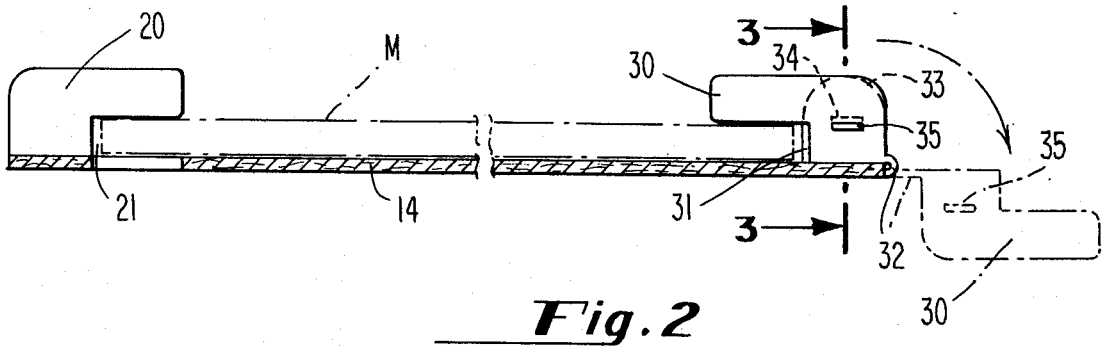
FIG. 2 is a view looking along the line 2—2 of FIG. 1.
Figure 3:
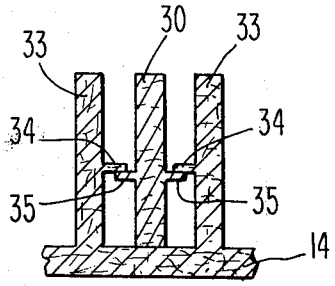
FIG. 3 is a view, in section, looking along the line 3—3 of FIG. 2.
Figure 4:
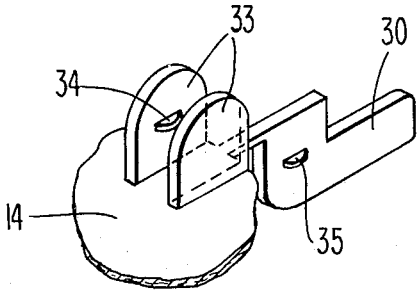
FIG. 4 is a detailed perspective view of a locking finger in accordance with one form of the present invention.

As seen best in FIG. 2, at the lower edge of the hinge portion 14 is a fixed rigid finger 20 of L-shaped configuration forming a slot 21 which receives the one edge of the center fold portion of the magazine M, shown in phantom in FIG. 2.

As also seen best in FIG. 2, at the opposite edge of the hinge portion 14, is a pivotal rigid finger 30, also of L-shaped configuration, which, when in the position shown in solid line in FIG. 2, forms a slot 31 which receives the other edge of the center fold portion of the magazine M.

Thus, the fingers 20 and 30 in the positions shown in solid line in FIG. 2 function to retain the magazine M within the binder 10.

To facilitate inserting the magazine M into the slots 21 and 31, the finger 30, in accordance with the present invention, is made pivotal as indicated in phantom in FIG. 2. The pivotal movement of finger 30 is made possible by the flexible strap connection 32 of the finger 30 to the edge of the hinge portion 14.

In accordance with the present invention, locking means are provided for retaining the pivotal finger 30 in the closed position shown in solid line in FIG. 2. Several locking means are shown in the present application.

A preferred form of locking means is shown in FIGS. 1–4. As there seen, connected to the one edge of hinge portion 14 are a pair of upstanding ears 33 having on their inner surfaces bosses 34 which face each other. The outer surfaces of finger 30 are provided with bosses 35 so positioned relative to the bosses 34 of ears 33 that when the finger 30 is folded over and down between the ears 33, the bosses 35 are cammed past the bosses 34 and become locked therebeneath, as seen in cross section in FIG. 3. In this manner, the pivotal finger 30 is locked into the position shown in solid line in FIG. 2, thereby locking the magazine M in the binder. To remove the magazine, the locking finger 30 is lifted and pivoted to the phantom position illustrated in FIG. 2.

Figure 5:
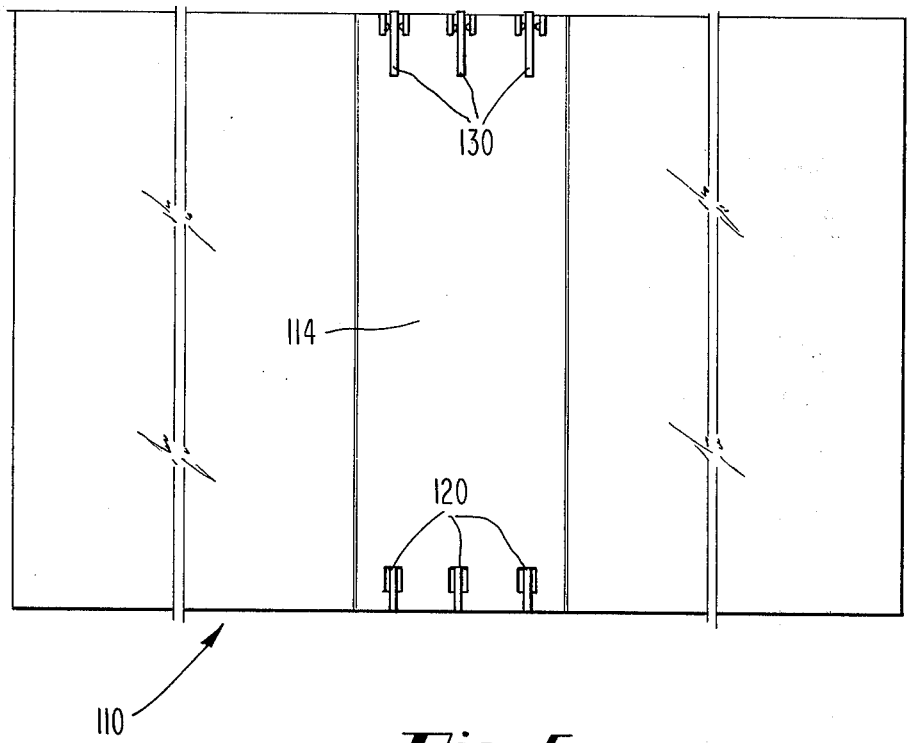
FIG. 5 is a plan view of a form of binder adapted to accommodate up to three magazines.

In FIG. 5, the binder 110 is similar to that of binder 10 of FIG. 1 with the exception that the hinge portion 114 is wider, sufficiently wide to accommodate three sets of locking fingers. Thus, binder 110 is able to hold from one to three magazines. In the binder 110, the fingers 120 are fixed and correspond to finger 20 of binder 10. The fingers 130 are pivotal from open position to locked position and correspond to finger 30 of binder 10.

Figure 6:
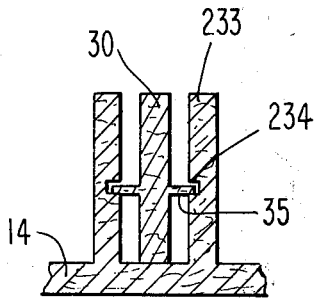
FIG. 6 is a view, in section, of a modified form of locking mechanism.

FIG. 6 illustrates a modified form of locking means. In FIG. 6, the ears 233 instead of being provided with bosses as in FIGS. 1–4, are provided with recesses 234 for receiving the bosses 35 of the finger 30.

Figure 7:
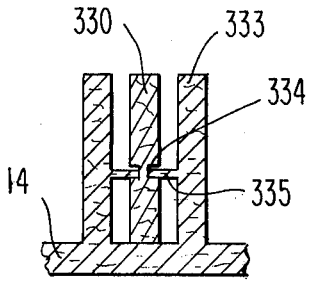
FIG. 7 is a view, in section, of yet another form of locking mechanism.

FIG. 7 illustrates a further modification basically similar to that of FIG. 6 but reversed in that the ears 333 are provided with inwardly projecting bosses 335 and the finger 330 is provided with recesses 334 in its walls for receiving the bosses.

In preferred form, the binder disclosed in the present patent application may be molded in one piece. The fixed locking fingers may be molded as an integral part of the binder. The pivotal fingers and the locking ears may preferably be provided at but one edge of the binder. However, if desired, such locking means may be provided at both edges.

The binder disclosed in the present application has been described as a binder for magazines and periodicals. It will be understood, however, that the binder may also be used for other purposes, such as a holder for paperback sales books, memo pads, and other paper documents, as well as a holder for paper back magazines and periodicals.

Use of the binder has the advantage, of course, of protecting and guarding the magazines or other contents against soiling, tearing and wrinkling.

If desired, the inside surfaces of the front and back cover portions may be provided with depressed areas for receiving advertising or other material.

What is claimed is:

1. A binder for magazines, said binder comprising:

a. a front cover portion;

b. a back cover portion;

c. a hinge portion hingedly connected at its opposite edges to said front and back cover portions;

d. a first single fixed L-shaped finger having base and leg portions, said base portion being fixed to said hinge portion at one end of the hinge portion and said leg portion projecting inwardly above the hinge portion at a spaced distance therefrom, said spacing forming a first slot at one end of said hinge portion for receiving an edge portion of the centerfold portion of a magazine;

e. a second single L-shaped finger having base and leg portions;

f. a flexible strap pivotably connecting said base portion of said second finger to the opposite end of said hinge portion;

g. locking means at said opposite end of said hinge portion;

h. said locking means comprising a pair of spaced upstanding ears, each ear having a boss projecting inwardly toward the other ear;

i. said base portion of said second finger being provided with bosses extending laterally outwardly therefrom and adapted to be cammed past the inwardly extending bosses of said ears to lock said finger between said ears;

j. said second finger being pivotable inwardly on said flexible strap from an outwardly extending position to an inwardly extending position with its base portion disposed between said ears and its leg portion spaced above the hinge portion, said space forming a second slot for receiving and retaining said magazine at said opposite edge of its centerfold portion with said losses on the base portion of said second finger cooperating with the inwardly extending bosses of said ears to lock said second finger between said ears.

2. A magazine binder according to claim 1 wherein:

a. said hinge portion is provided with a plurality of similar fixed fingers forming a plurality of first slots;

b. a plurality of similar separately pivotable second fingers are provided; and c. a plurality of similar locking means are provided.

* * * * *